US010648155B2

(12) United States Patent
Wagner et al.

(10) Patent No.: US 10,648,155 B2
(45) Date of Patent: May 12, 2020

(54) MULTIPLE TOOL CONSTRUCTION MACHINE

(71) Applicant: Guangxi LiuGong Machinery Co., Ltd., Liuzhou Guangxi (CN)

(72) Inventors: Edward Wagner, Guangxi (CN); Gary Major, Staffordshire (GB); Yunfeng Zhao, Guangxi (CN)

(73) Assignee: Guangxi LiuGong Machinery Co., Ltd., Liuzhou, Guangxi (CN)

( * ) Notice: Subject to any disclaimer, the term of this patent is extended or adjusted under 35 U.S.C. 154(b) by 0 days.

(21) Appl. No.: 16/110,067

(22) Filed: Aug. 23, 2018

(65) Prior Publication Data

US 2019/0368158 A1 Dec. 5, 2019

Related U.S. Application Data

(63) Continuation of application No. PCT/CN2018/089545, filed on Jun. 1, 2018.

(51) Int. Cl.
*E02F 3/96* (2006.01)
*E02F 9/16* (2006.01)
(Continued)

(52) U.S. Cl.
CPC ..... *E02F 3/439* (2013.01); *E02F 3/146* (2013.01); *E02F 5/145* (2013.01); *E02F 9/24* (2013.01)

(58) Field of Classification Search
CPC . E02F 5/145; E02F 3/964; E02F 3/965; E02F 3/439; E02F 3/146; E02F 3/966; E02F 9/003; E02F 9/24
(Continued)

(56) References Cited

U.S. PATENT DOCUMENTS 4,869,002 A * 9/1989 Glenn ..... E02F 3/384 37/403
6,125,945 A * 10/2000 Skaggs ..... A01B 59/043 172/439
(Continued)

FOREIGN PATENT DOCUMENTS

CN 101413279 A 4/2009
CN 203420297 U 2/2014
(Continued)

OTHER PUBLICATIONS

Extended European Search Report in European Patent Application No. 18187239.1, dated Apr. 17, 2019, 13 pgs.
(Continued)

*Primary Examiner* — Robert E Pezzuto
(74) *Attorney, Agent, or Firm* — Young Basile Hanlon & MacFarlane, P.C.

(57) ABSTRACT

A construction machine that includes a machine frame and an articulated boom. The articulated boom is pivotably mounted to the machine frame. The construction machine is configured to be operated in a loader mode in which a first tool is mounted to the articulated boom, and in an excavator mode in which a second tool is mounted to the articulated boom. The construction machine further includes a tool storage for storing the first tool and/or the second tool. The construction machine is configured to replace one of the first tool and second tool when mounted to the articulated boom with the other one of the first tool and second tool when stored in the tool storage.

20 Claims, 10 Drawing Sheets

(51) Int. Cl.

| | |
|---|---|
| ***E02F 3/43*** | (2006.01) |
| ***E02F 3/14*** | (2006.01) |
| ***E02F 5/14*** | (2006.01) |
| ***E02F 9/24*** | (2006.01) |

(58) Field of Classification Search
USPC ..... 37/403–410, 468; 414/694, 685, 687; 172/245
See application file for complete search history.

(56) References Cited

U.S. PATENT DOCUMENTS

| | | | | |
|---|---|---|---|---|
| 7,257,910 | B2 * | 8/2007 | Underwood | E02F 3/425 37/403 |
| 7,421,952 | B2 * | 9/2008 | Taylor | B61D 15/02 104/2 |
| 8,539,699 | B2 * | 9/2013 | Ramun | B23D 31/008 37/403 |
| 9,127,442 | B1 * | 9/2015 | Underwood | E02F 3/964 |

FOREIGN PATENT DOCUMENTS

| | | | |
|---|---|---|---|
| DE | 102006005213 | A1 | 12/2006 |
| EP | 1997964 | A2 | 12/2008 |

OTHER PUBLICATIONS

International Search Report in International Patent Application No. PCT/CN2018/089545, dated Feb. 21, 2019, 5 pgs.

* cited by examiner

MULTIPLE TOOL CONSTRUCTION MACHINE

CROSS-REFERENCE TO RELATED APPLICATION(S)

This application claims priority to PCT/CN2018/089545 filed Jun. 1, 2018, the content of which is incorporated herein in its entirety by reference.

TECHNICAL FIELD

This disclosure relates to multiple tool construction machines.

BACKGROUND

On most construction sites, loaders and excavators are used for earthworks or material handling. Loader-type machines and excavator-type machines are often used next to each other for carrying out respective loading works and excavating works.

For providing the functionalities of a loader and an excavator on a single machine, multiple function construction machines with two separate booms, i.e. a loader boom at the front end of the machine with a loader bucket mounted thereto and an excavator boom at the rear end of the machine with an excavator bucket mounted thereto, are used on construction sites. For changing the operational mode of such a complex construction machine, the machine operator needs to change his sitting position for changing his field of view and for aligning himself to an instrument panel of the respective boom.

Furthermore, construction machines are known having a single boom at the front of the machine, the boom being operable in an excavator mode as well as in a loader mode. For changing the tool of the construction machine, the machine needs to lay down the tool of the one mode on and pick up the tool of the other mode from the ground of the construction site. Thus, changing of tools may be time consuming as the construction machine needs to be moved to the tool that needs to be picked up, the tool potentially being situated remote from the current working position.

SUMMARY

Disclosed herein are aspects, features, elements, implementations, and embodiments of multiple tool construction machines.

An aspect of the disclosed embodiments is a construction that includes a machine frame or machine body and an articulated boom, which is pivotably mounted to the machine frame. The construction machine is configured to be operated in a loader mode, in which a first tool is mounted to the articulated boom, and in an excavator mode, in which a second tool, which is different from the first tool, is mounted to the articulated boom. In the loader mode, the construction machine is arranged to perform conventional loader, additionally wheel loader, tasks. Additionally, or alternatively, the construction machine is configured to perform conventional dozer tasks in the loader mode. In the excavator mode, the construction machine is arranged to perform conventional excavator tasks. The configuration of the construction machine to be operated in the loader and excavator modes implies that the machine is arranged, e.g. programmed, to perform the conventional loader and excavator tasks.

The articulated boom of the construction machine may be a multi-armed working device, in particular a three-armed boom. Arms of the boom may be connected by articulations or joints. The articulated boom may exhibit different effective configurations between the different operational modes of the construction machine. For example, in the loader mode, the articulated boom may be effectively configured as a two-armed boom and/or, in the excavator mode, the boom may be effectively configured as a three-armed boom. A proximal arm of the articulated boom may be locked to the machine frame in the loader mode, wherein, in the excavator mode, this proximal arm of the articulated boom may not be locked to the machine frame.

The construction machine further comprises a tool storage for storing the first tool and/or the second tool. The tool storage is configured to store a tool, which is not mounted to the boom and which is therefore currently not in use. The construction machine is configured to replace one of the first tool and second tool, which is mounted to the articulated boom, with the other one of the first tool and second tool, which is not mounted to the boom but stored in the tool storage. The tool storage may be a tool deposit and/or a tool retainer. The first tool and the second tool can be different, for example have different sizes, volumes and/or shapes. The configuration of the construction machine to replace the tool, which is mounted to the boom, with the tool, which is provided in the tool storage, implies that the machine is arranged, e.g. programmed, to conduct this task.

A core idea of the disclosure resides in the fact that a construction machine with a single multi-functional boom is configured to change its mode of operation in situ. In other words, the construction machine is designed to completely change its tools and its mode of operation at an arbitrary position, as the machine itself carries the different tools for the different modes of operation. Accordingly, a tool change can be carried out without macroscopically moving the machine. A further advantageous effect may be seen in that a tool, which is not in use, does not have to be put aside or stored in a warehouse, but is directly available on the construction machine for use when needed.

The construction machine according to the disclosure may comprise a chassis, wherein the machine frame may be pivotably mounted to the chassis. The machine frame may be pivotable with respect to the chassis around a vertical axis. The chassis may comprise an arrangement for locomotion of the construction machine on the ground. For that purpose, the chassis may comprise a chain drive and/or a wheel drive. The chassis may also be defined as a lower machine frame of the construction machine. The articulated boom can be mounted to the machine frame and/or the chassis.

The tool storage may comprise a first tool carrier adapted to carry the first tool and a second tool carrier being separate from the first tool carrier and being adapted to carry the second tool. The first tool carrier and/or the second tool carrier may comprise a tool shelf and/or a tool holder. The first tool carrier and the second tool carrier may be provided at different locations of the construction machine. The provision of a first and a second tool carrier on the construction machine has the advantage that picking and depositing of the first and second tools during a change of the mode of operation may be carried out without putting down one of the tools on the ground. Thus, both the first tool and the second tool may be provided on the construction machine during all phases of operation. The first tool carrier and/or the second tool carrier may comprise a housing for enclosing the first and/or second tool.

The first and/or second tool carrier can be arranged on the construction machine in a movable manner. The tool carrier can be arranged on the machine frame or on the chassis in a pivotable and/or shiftable manner such that it can be pivoted and/or shifted with respect to the machine frame or to the chassis. The tool carrier can be arranged on the left or right side of the machine frame, and can be pivoted to the front or rear side of the construction machine with respect to the forward moving direction thereof. Thus, tools can be picked or deposited by the articulated boom at the front or rear of the machine without the need of pivoting the boom around a vertical axis, as the tool carrier itself is able to pivot towards the boom.

According to an embodiment of the construction machine according to the disclosure, the first tool carrier is arranged at the chassis and the second tool carrier is arranged at the machine frame of the construction machine. For picking and depositing the first tool from/in the first tool carrier, the articulated boom may be pivoted to the first tool carrier by pivoting the machine frame relative to the chassis. For picking and depositing the second tool from/in the second tool carrier, the second tool carrier may be moved, in particular pivoted, towards the articulated boom. This embodiment has the advantage that the first tool for the loader mode, which is usually bulky and rather heavy, may be provided at a lower portion of the construction machine so as to minimize loading. Additionally, this embodiment allows for an optimal utilization of space on the construction machine for storing the different tools.

The first tool carrier may comprise first retaining means for holding the first tool and/or the second tool carrier may comprise second retaining means for holding the second tool. A retaining means may comprise at least one clamp for engaging with a tool to be carried. The retaining means may be adapted to exert a pressing force onto the tool to be held. Alternatively, or additionally, the retaining means may comprise at least one pin for engaging with the tool to be carried. The pin may be hydraulically or electrically driven. Providing a retaining means may increase a safe stowing of tools on the construction machine.

According to an embodiment, the construction machine according to the disclosure comprises a first tool mountable to the articulated boom in the loader mode and a second tool mountable to the articulated boom in the excavator mode. The first tool and the second tool as well as the articulated boom may be configured such that the tools may be picked by a tool mount at the distal end of the articulated boom, and may operate without the support of an operator. In other words, picking and depositing of a tool can be conducted by the construction machine itself.

The first tool may be a loader bucket, and the second tool may be an excavator bucket. The first tool carrier may be adapted to carry the loader bucket and the second tool carrier may be adapted to carry the excavator bucket. The loader bucket may have a larger bucket volume compared to the excavator bucket. The loader bucket may be wider than the excavator bucket. The loader bucket may be configured to be used as a dozer tool.

Pursuant to an embodiment of the construction machine according to the disclosure, the tool storage is further configured to simultaneously store a third tool. The second tool carrier may be configured to carry the third tool additionally to the second tool. Additionally, or alternatively, the second tool carrier comprises a retaining means for locking the second and a further retaining means for locking the third tool. Alternatively, or additionally, the construction machine may comprise an additional third tool carrier for carrying the third tool. The third tool carrier may be separate from the first and/or second tool carrier. The construction machine may be configured to pick and deposit the third tool from the tool storage with the articulated boom. Hence, the construction machine according to the disclosure may be a multiple tool construction machine with three tools for different operational tasks, wherein all of these tools may be carried simultaneously by the construction machine.

The construction machine according to the disclosure may comprise a third tool mountable to the articulated boom in the excavator mode. The third tool may be a hammer. The hammer may be a hydraulic hammer for loosening of concrete and/or rock. Additionally, or alternatively, the construction machine may comprise a cutter head, a crusher, a drilling tool, a fork for lifting pallets, a hook, and/or a basket for lifting a human. Additionally, or alternatively, the tool storage is configured to carry the additional tool(s), and the construction machine is configured to automatically pick and deposit the tool(s) from/in the tool storage with the articulated boom.

Pursuant to an embodiment of the construction machine according to the disclosure, the articulated boom comprises multiple (e.g., three) arms pivotably connected in series to each other, wherein the construction machine further comprises a locking device for selectively locking the arm of the articulated boom, which is directly connected to the machine frame, so as to block any relative movement between the arm and the machine frame in the loader mode. The arm of the articulated boom, which is directly connected to the machine frame, may also be defined as a proximal arm. The proximal arm may be connected to an intermediate arm and the intermediate arm may be connected to a distal arm. The locking device allows for an easy change of the operational mode of the construction machine between the loader mode and the excavator mode. Specifically, via the locking device, the effective configuration of the articulated boom can be changed from a three-armed boom in the excavator mode to a two-armed boom in the loader boom, allowing for an increased stiffness in the loader mode and an increased operational flexibility in the excavator mode.

Furthermore, the present disclosure relates to a method of changing an operational mode of a construction machine with an articulated boom. The construction machine may be the construction machine according any of the above described embodiments. The method comprises the step of depositing, by the articulated boom, a tool, which is mounted to the articulated boom, for one of a first and second operational modes. Subsequently, the method comprises the step of picking, by the articulated boom, a tool for the other one of the first and second operational modes from a tool storage provided on the construction machine. Picking the first tool or the second tool by the articulated boom may comprise mounting or installing the selected tool on a tool mount at a distal end of the boom. This step can be carried out automatically by the boom without manual intervention.

Pursuant to an embodiment of the method according to the disclosure, the tool is deposited in the tool storage. Thus, the tool for one of the first and second operational modes, which is mounted to the articulated boom, may be deposited in the tool storage before picking the tool for the other one of the first and second operational modes from the tool storage. Depositing and picking is carried out by the articulated boom itself. This embodiment has the advantage that both tools are provided on the machine during a tool change. Thus, none of the tools has to be put down on the ground or somewhere else. A further advantage resides in the fact that no additional machine or tool is needed for conducting a tool change.

According to a further aspect of the disclosure, a method of selecting an operational mode of a construction machine with an articulated boom is provided. The construction machine is operable in a first operational mode and in a second operational mode, which is different from the first operational mode. Additionally, or alternatively, the construction machine is the construction machine according to any of the above described embodiments. The method comprises the step of simultaneously providing a first tool for the first operational mode and a second tool for the second operational mode on the construction machine, and selecting and picking one of the first tool and second tool by the articulated boom for operation of the construction machine in the first or second operational mode. Providing the first tool and the second tool on the construction machine may be understood as carrying, holding and/or supporting these tools on or by the construction machine. In other words, the construction machine may simultaneously carry, hold and/or support at least two tools.

Pursuant to an embodiment, a method according to the disclosure comprises the step of locking an arm of the articulated boom that is directly connected to a machine frame, i.e. a proximal arm, to the machine frame of the construction machine so as to block any relative movement between the arm and the machine frame. Locking the proximal arm may enable the construction machine to operate in a loader mode, and unlocking the proximal arm may enable the construction machine to operate in an excavator mode. The articulated boom may be a three-armed boom, which may effectively be reduced to a two-armed boom by locking the proximal arm.

Pursuant to an embodiment, the first operational mode is a loader mode and the second operational mode is an excavator mode.

The present disclosure further relates to a control system which is configured to execute the method of selecting a tool on a construction machine and/or the method of changing a tool on a construction machine according any of the above described embodiments.

Another aspect of the disclosed embodiments is a construction machine that is configured to be operated in a loader mode and in an excavator mode. Such a construction machine may be defined as a combined loader-excavator-machine.

Another aspect of the disclosed embodiments is a method of selecting a tool of a construction machine having an articulated boom.

Another aspect of the disclosed embodiments is a method of changing a tool of a construction machine having an articulated boom.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

Variations in these and other aspects, features, elements, implementations, and embodiments of the methods, apparatus, procedures, and algorithms disclosed herein are described in further detail hereafter.

DETAILED DESCRIPTION

Embodiments of the present disclosure are subsequently described with reference to the attached FIGS. 1 to 22.

FIGS. 1 to 6 show a multi tool construction machine 1 according to an embodiment of the present disclosure, wherein the construction machine 1 is shown in different operational modes. The construction machine 1 comprises a chassis 4, an upper structure 5 and an articulated boom 2.

The chassis 4 may be a chain-driven chassis 4 or a wheel-driven chassis (not shown). The upper structure 5 may be arranged on the chassis 4 in a pivotable manner to be rotatable with respect to the chassis 4. The rotatability of the upper structure 5 with respect to the chassis 4 may be provided around a vertical axis of rotation. Additionally, or alternatively, the upper structure 5 is 360°-rotatable with respect to the chassis 4.

Figure 8:
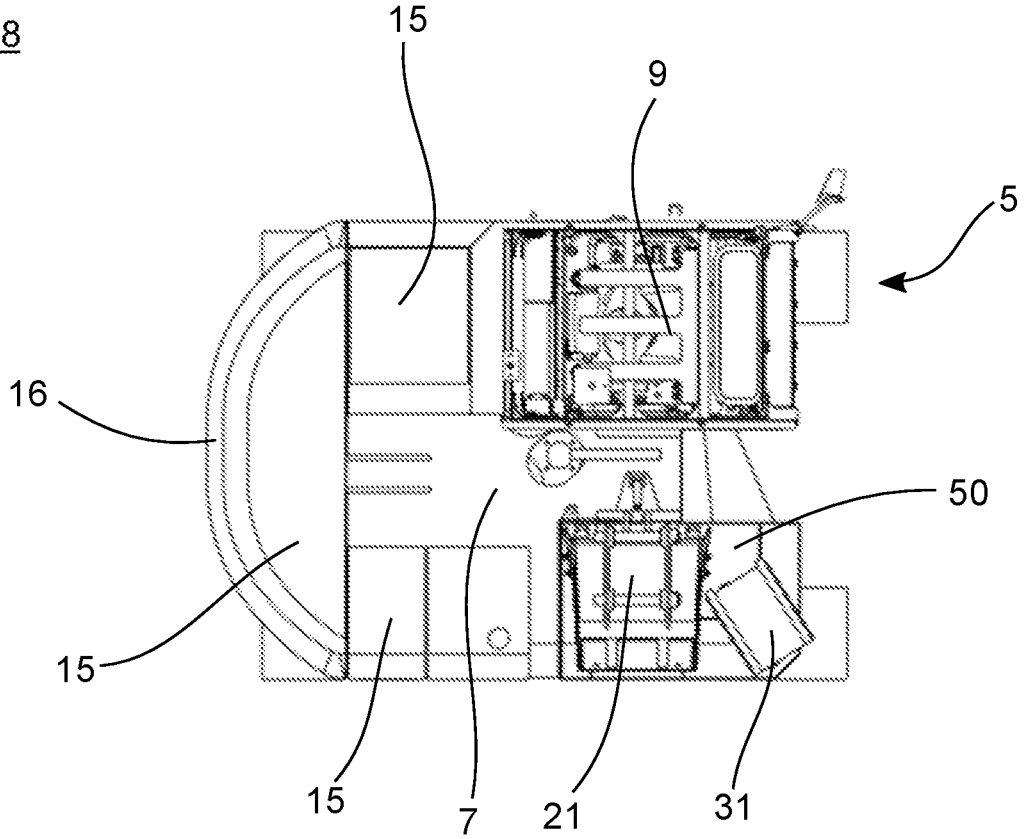
FIG. 8 generally illustrates a plan view of an upper side of the upper structure of the construction machine of FIG. 1 with the tool changer in the stored condition.
Figure 10:
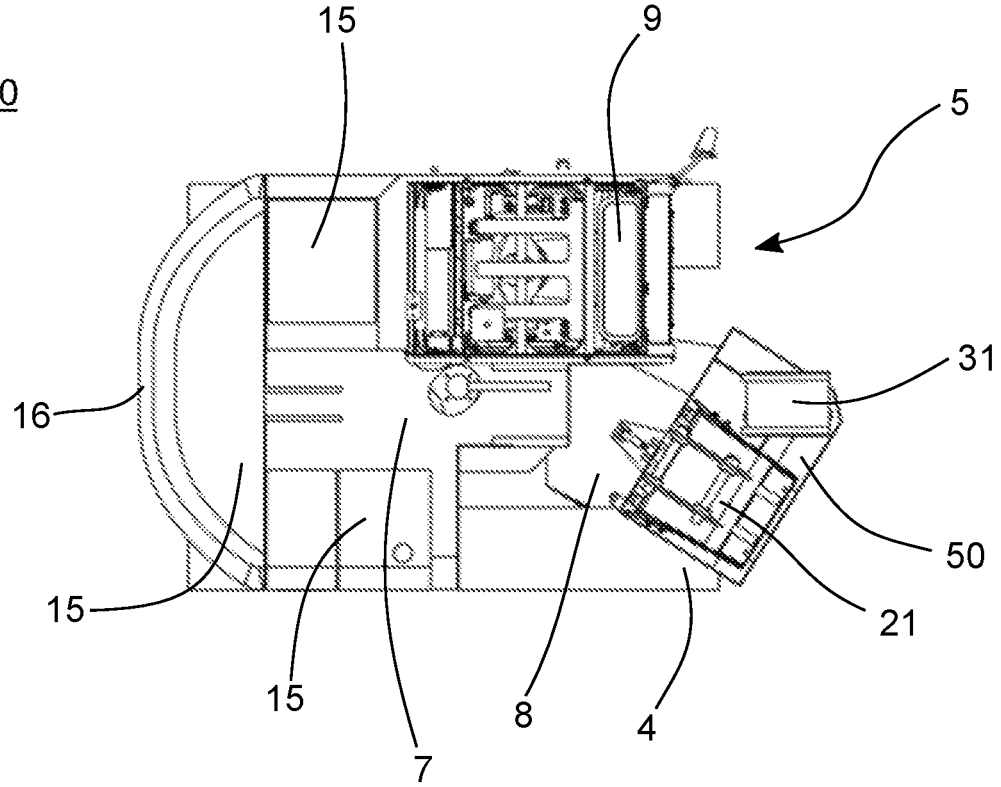
FIG. 10 generally illustrates a plan view of the upper side of the upper structure of the construction machine of FIG. 1 with the tool changer in the alignment condition.
Figure 12:
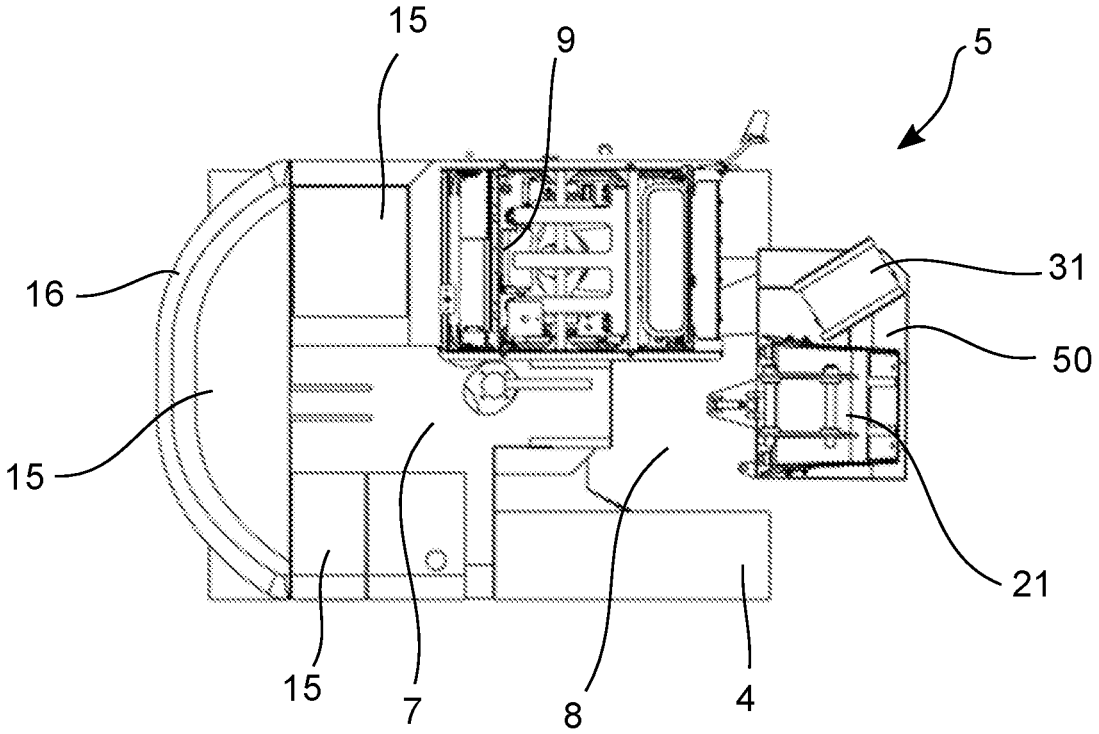
FIG. 12 generally illustrates a plan view of the upper side of the upper structure of the construction machine of FIG. 1 with the tool changer in the further alignment condition.
Figure 13:
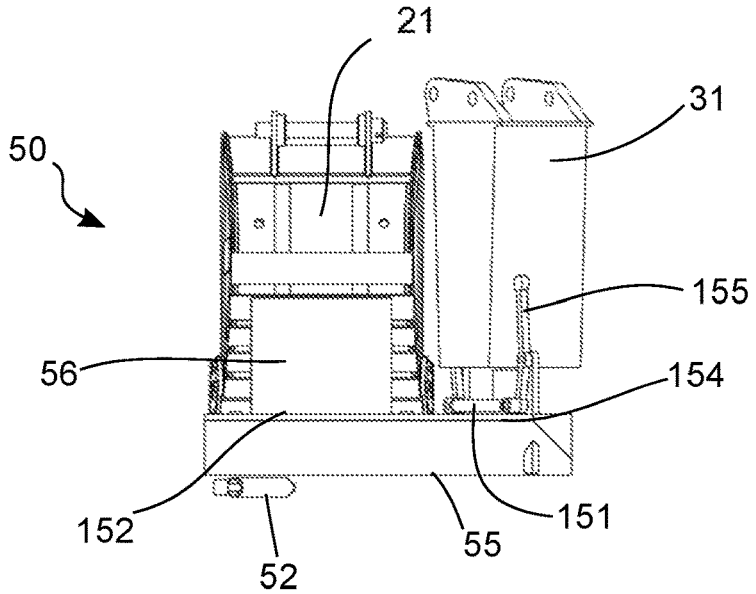
FIG. 13 generally illustrates a side view of a loaded tool changer of the construction machine of FIG. 1 according to the principles of the present disclosure.
Figure 14:
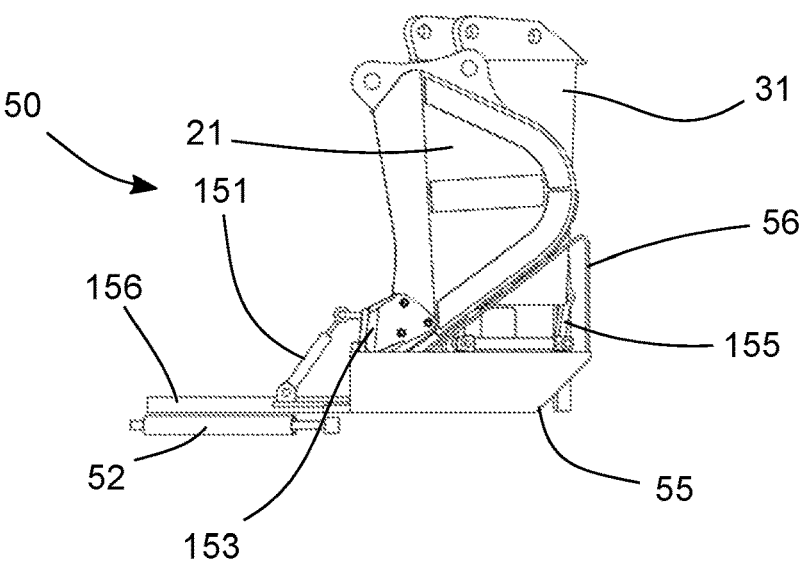
FIG. 14 generally illustrates a further side view of the loaded tool changer of FIG. 13.
Figure 15:
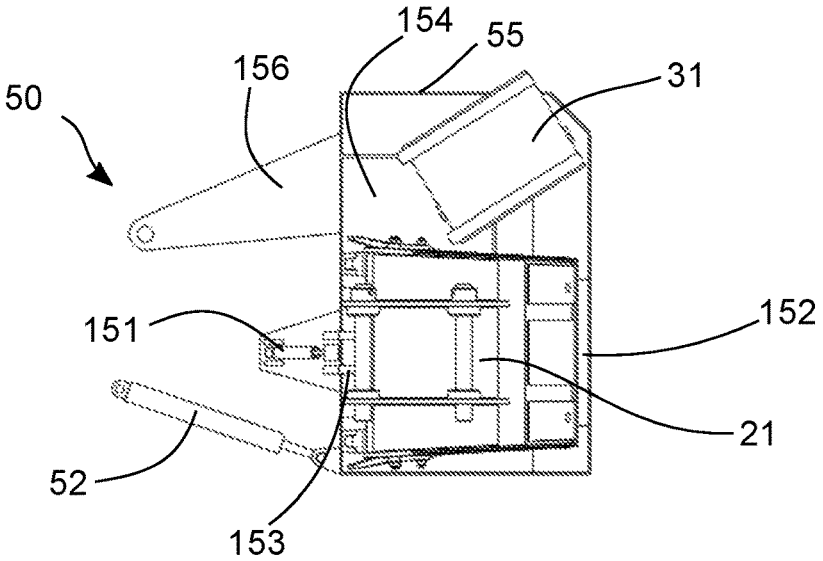
FIG. 15 generally illustrates a plan view from above the loaded tool changer of FIG. 13.
Figure 16:
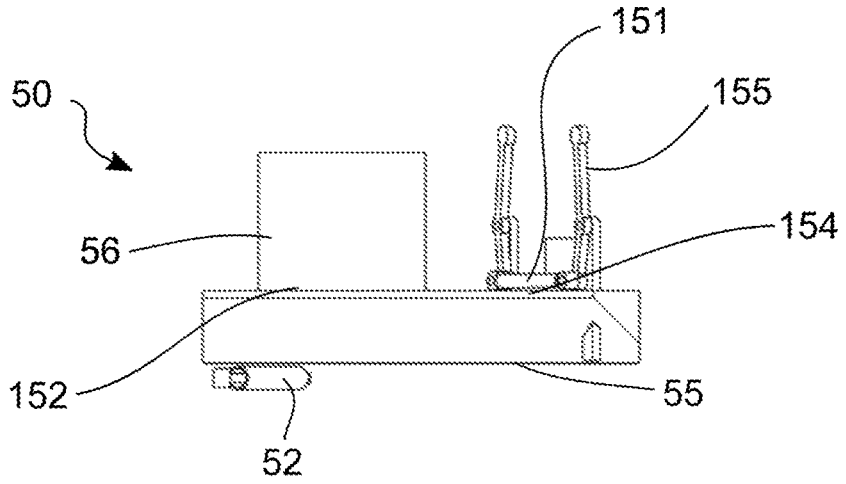
FIG. 16 generally illustrates a side view of the tool changer of FIG. 13 without tools.
Figure 17:
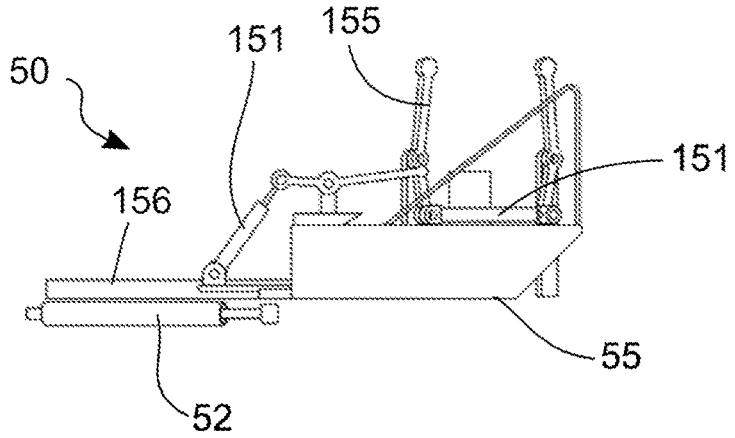
FIG. 17 generally illustrates a further side view of the tool changer of FIG. 16.
Figure 18:
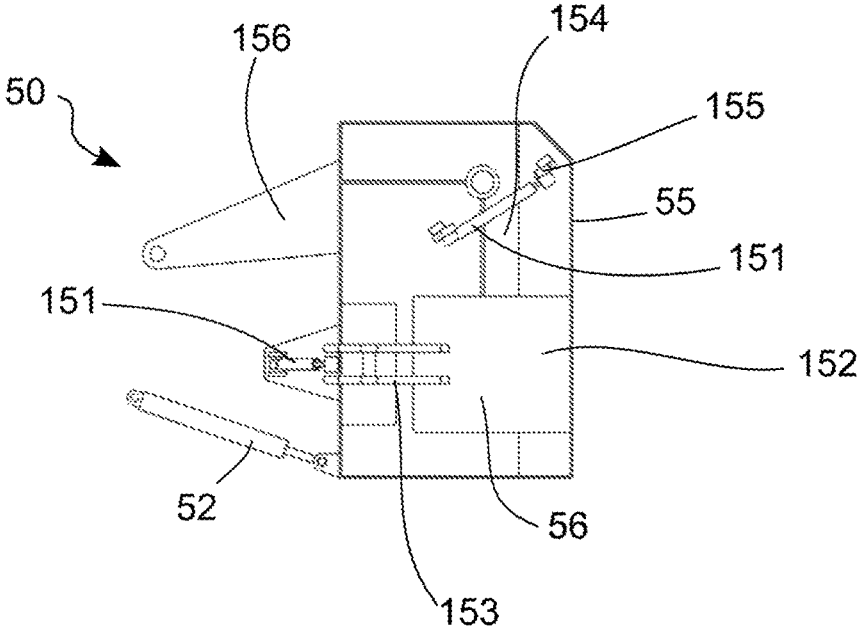
FIG. 18 generally illustrates a plan view from above the tool changer of FIG. 16.

The upper structure 5 may comprise a machine frame 6 as a base frame or basic framework of the upper structure 5. The upper structure 5 may further comprise a driver's cabin 9, an engine-hydraulic unit 15, and/or a counterweight 16. The upper structure 5 may further comprise at least one battery (not shown) and at least one electric motor (not shown), which may be connected to the battery for operating the multi tool construction machine 1 or at least one component thereof. For example, the chassis 4, the upper structure 5, and/or the articulated boom 2 may be operated by the electric motor. A hydraulic pump (not shown) for operating hydraulic actuators and a swing drive (not shown) for rotating the upper structure 5 with respect to the chassis 4 may further be provided. The electric motor may drive the hydraulic pump. The driver's cabin 9, the engine-hydraulic unit 15, and the counterweight 16 may be arranged on the machine frame 6. The upper structure 5 may further comprise a recess 7. The recess 7 may be formed above the machine frame 6 for accommodating at least part of the articulated boom 2, i.e. the proximal arm 62, when being folded towards or against the machine frame 6. The driver cabin 9, the engine-hydraulic unit 15, and/or the counterweight 16 may be arranged around the recess 7. In other words, the recess 7 may be surrounded by the driver cabin 9, the engine-hydraulic unit 15 and/or the counterweight 16. As illustrated in FIGS. 8, 10, and 12, the engine-hydraulic unit 15 may be arranged on both sides of the recess 7. The driver cabin 9 as well as the engine-hydraulic unit 15 may be arranged on opposite sides of the upper structure 5 and the machine frame 6, respectively. The articulated boom 2 may be arranged between the driver cabin 9 and the engine-hydraulic unit 15.

The articulated boom 2 may be arranged on the upper structure 5, wherein the articulated boom 2 may be in particular a three-armed boom 2 or a two-armed boom (not shown). At one boom end, the articulated boom 2 may be pivotably attached to the machine frame 6 by means of a first articulation 61. The first articulation 61 may be a pivot joint. The first articulation 61 may be provided at a central position of the machine frame 6 in widthwise direction of the upper structure 5 and in front of to the vertical axis of rotation of the upper structure 5 in lengthwise direction of the upper structure 5. At the other end of the articulated boom 2, which is not attached to the machine frame 6, a tool mount 3 may be pivotably arranged.

The articulated boom 2 may comprise a proximal arm 62, an intermediate arm 64 and a distal arm 66. The proximal arm 62 may be hinged to the machine frame 6 by means of the first articulation 61, the intermediate arm 64 may be hinged to the proximal arm 62 by means of a second articulation 63 and/or the distal arm 66 may be hinged to the intermediate arm 64 by means of a third articulation 65. The articulations 61, 63, 65 may be designed as pivoting joints. The first articulation 61 may interconnect the proximal arm 62 and the upper structure 5 and the machine frame 6, respectively, the second articulation 63 may interconnect the intermediate arm 64 and the proximal arm 62 and the third articulation 65 may interconnect the distal arm 66 and the intermediate arm 64.

The articulated boom 2 may further comprise a first positioning cylinder 82 for pivoting the proximal arm 62, a second positioning cylinder 84 for pivoting the intermediate arm 64, a third positioning cylinder 86 for pivoting the distal arm 66 and/or a fourth positioning cylinder 88 for pivoting the tool mount 3.

The first positioning cylinder 82 may be hinged to the machine frame 6 rearward of the first articulation 61. Furthermore, the first positioning cylinder 82 may be hinged to the backside of the distal end of the proximal arm 62, the backside being that side which is facing away from the intermediate arm 64. The first positioning cylinder 82 may be a boom cylinder for pivoting the entire articulated boom 2 with respect to the machine frame 6. The second positioning cylinder 84 may be hinged to the distal end of the proximal arm 62 and to a distal end of the intermediate arm 64. The second positioning cylinder 84 may be arranged beneath the intermediate arm 64. The third positioning cylinder 86 may be hinged to a proximal end of the intermediate arm 64 and to a proximal end of the distal arm 66. The third positioning cylinder 86 may be arranged above the intermediate arm 64 and/or above the second positioning cylinder 84. The second positioning cylinder 84 and the third positioning cylinder 86 may be arranged substantially parallel to each other in all operating positions of the boom. The fourth positioning cylinder 88 may be hinged to a proximal end of the distal arm 66 and to the tool mount 3 at the distal end of the distal arm 66. The fourth positioning cylinder 88 may be arranged above the distal arm 66, i.e. on that side of the distal arm 66 which is facing away from the proximal arm 62.

Different tools 10, 20, 30 may be provided on the construction machine 1, which are configured to be mounted to the tool mount 3 that may be pivotably attached to the distal arm 66. A fourth articulation 67 may interconnect the distal arm 66 and the tool mount 3. Tools 10, 20, 30 not mounted to the tool mount 3 are carried by the construction machine 1. A first tool 10 may be a loader bucket 11, a second tool 20 may be an excavator bucket 21 and a third tool 30 may be a hammer 31, wherein at least the loader bucket 11 and the excavator bucket 21 may be provided on the construction machine 1. The hammer 31 may be a hydraulic hammer. Alternatively, or additionally, only two tools out of the different tools 10, 20, 30 may be provided on the machine.

The chassis 4 may comprise a first tool carrier 40 and the upper structure 5 may further comprise a second tool carrier 50, wherein the first tool carrier 40 and/or the second tool carrier 50 may provide a tool storage on the construction machine 1. The second tool carrier may be configured as a tool changer 50. The first tool carrier 40 may be arranged at the rear side of the chassis 4 and may be configured to carry the first tool 10. The first tool carrier 40 may be tiltable and may be moved between an upward position as shown in FIGS. 1 to 5 and a downward position as shown in FIG. 6. The upward position may serve for carrying the first tool 10 and the downward position may serve for utilizing the first tool 10, e.g. the loader bucket 11, for carrying out dozer work with the construction machine 1. In other words, in the upward position, the first tool 10 is spaced from the ground, whereas it is in contact with or at least in proximity of the ground in the downward position. The first tool carrier 40 and/or the second tool carrier 50 may be powered by the at least one battery (not shown) and the at least one electric motor (not shown).

The second tool carrier 50 may be arranged at the front end of the upper structure 5, wherein the second tool carrier 50 may be positioned adjacent to the articulated boom 2 and/or in front of the engine-hydraulic unit 15. The articulated boom 2 may be arranged in between the driver cabin 9 and the second tool carrier 50. The second tool carrier 50 may be accommodated in a frame recess 8 of the machine frame 6 and may be pivoted from a stowed position, as shown in FIGS. 1, 3, 5, and 6, to at least one pivot position, as shown in FIGS. 2 and 4. Hereto, the second tool carrier 50 may be pivotably attached to the machine frame 6. A pivoting movement of the second tool carrier 50 may be provided by a positioning cylinder 52, for example a hydraulic positioning cylinder. Two tools 20, 30 may be carried on the second tool carrier 50. The tools 20, 30 may be the excavator bucket 21 and the hammer 31, both mountable to the tool mount 3.

Alternatively, or additionally, with respect to the movable attachment of the second tool carrier 50 to the machine frame 6, the second tool carrier 50 may also be attached to the machine frame 6 with at least two links or articulations (not shown). The links may be arranged on the machine frame 6 and/or on the second tool carrier 50, wherein the links may comprise swivel joints or pivot joints for supporting and pivotably moving the second tool carrier 50 from a stowed position, as for example shown in FIGS. 1, 3, 5, and 6, to at least one pivot position, as for example shown in FIGS. 2 and 4. The links may thus interconnect the second tool carrier 50 and the machine frame 6 in a hinge-like manner. The links may further provide a four-bar linkage or a crank rocker for pivoting the second tool carrier 50. The four-bar linkage may comprise four joints, two of those may be arranged on the machine frame 6. The second tool carrier 50 may be pivotably or rigidly attached to at least one of the two further joints of the four-bar linkage, which are not arranged on the machine frame 6 and which are both pivotably movable with respect to the machine frame 6. According to one of these mechanisms, the second tool carrier 50 may be moved on a segment of a circular arc. Such an attachment design of the second tool carrier 50 to the machine frame 6 may be advantageous, as it may provide more flexibility in positioning the second tool carrier 50 for a tool change.

Further alternatively, or additionally, with respect to the movable attachment of the second tool carrier 50 to the machine frame 6, the second tool carrier 50 may also be attached to the machine frame 6 with at least one not pivotable link (not shown). For example, the second tool carrier 50 may be attached to the machine frame 6 with two not pivotable links. The not pivotable one link may be arranged on the machine frame 6 and/or on the second tool carrier 50, wherein the not pivotable one link may be a slide or runner for carrying and linearly moving the second tool carrier 50 from a stowed position, as for example shown in FIGS. 1, 3, 5, and 6, to at least one moved out position, as for example shown in FIGS. 2 and 4. The not pivotable one link may thus interconnect the second tool carrier 50 and the machine frame 6 in a linearly adjustable manner. Herewith, the second tool carrier 50 may be moved along a linear path of movement. Thus, the at least one link may provide a linear pullout of the second tool carrier 50.

Different operational modes of the construction machine 1 are subsequently described with reference to the FIGS. 1 to 6.

Figure 1:
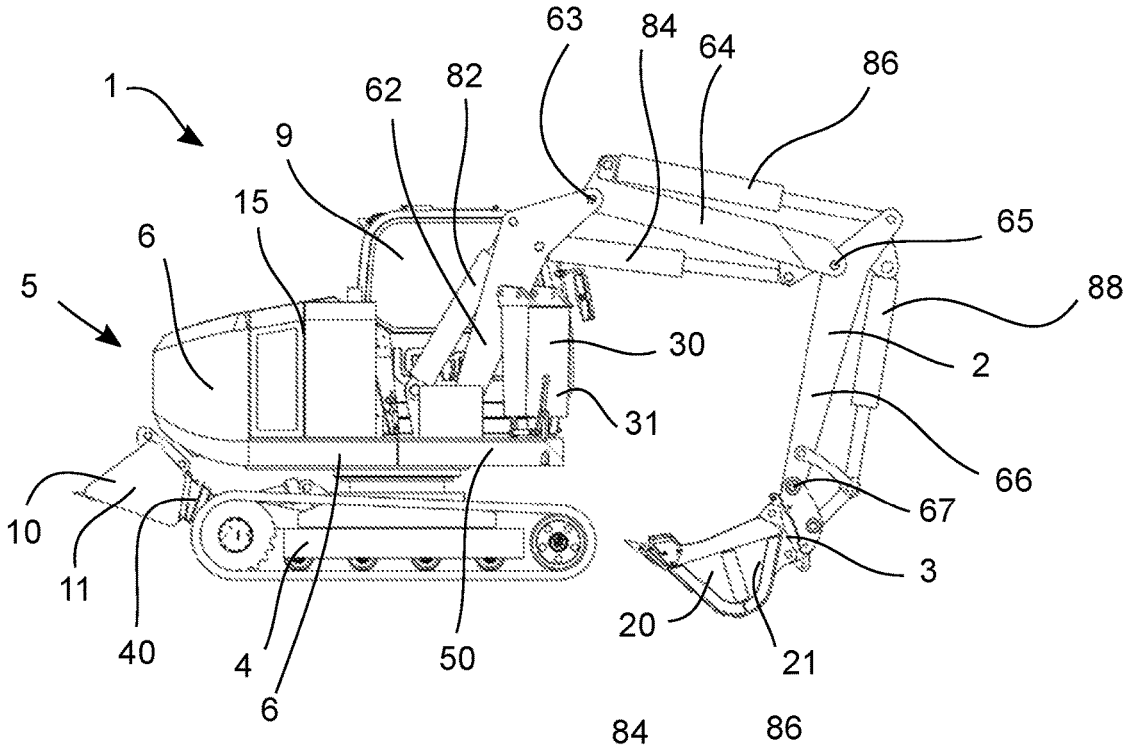
FIG. 1 generally illustrates a side view of a construction machine in an excavator mode according to the principles of the present disclosure.
Figure 2:
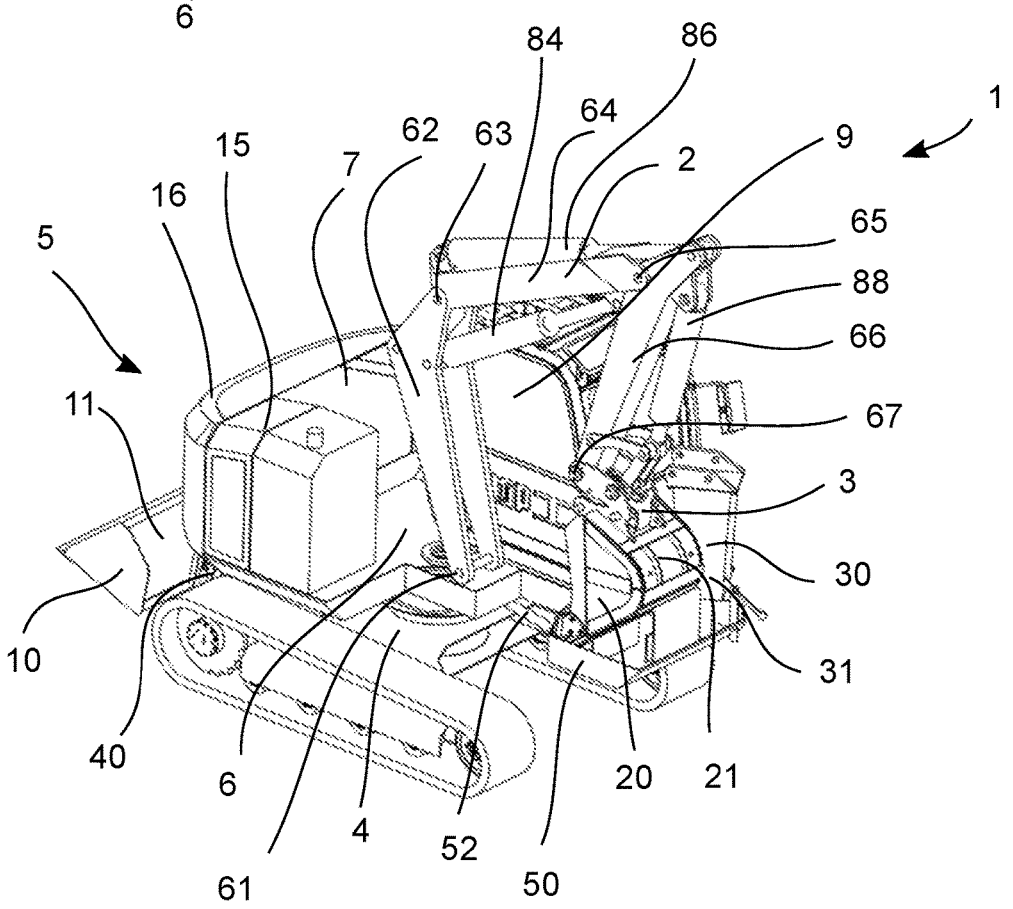
FIG. 2 generally illustrates a perspective view of the construction machine of FIG. 1 during an operational mode change to or from the excavator mode.

FIG. 1 shows the construction machine 1 in an excavator mode being an operational mode of the construction machine 1. In this operational mode, the articulated boom 2 may be arranged in an unlocked configuration such that all boom articulations 61, 63, 65, 67 are unlocked and all arms 62, 64, 66 are movable. In this excavator mode, the excavator bucket 21 may be mounted to the tool mount 3. The loader bucket 11 and the hammer 31 may be carried by the construction machine 1 by depositing them in the tool storage, i.e. the first tool 10 or second tool carrier 50.

FIG. 2 shows the construction machine of FIG. 1 during a step of selecting or picking of the excavator bucket 21 by the tool mount 3 attached to the distal arm 66 of the articulated boom 2 for operation of the construction machine 1 in the excavator mode as shown in FIG. 1. Hereto, the excavator bucket 21 may be taken by the tool mount 3 from a first tool retaining portion 152 of the second tool carrier 50. To allow for such a pickup, the second tool carrier 50 may be pivoted from a stowed position as shown in FIG. 1 to a first changing position. In the first changing position of the second tool carrier 50, the excavator bucket 21 may be picked from the tool carrier 50 by the tool mount 3. Thus, the first changing position is situated in a working space of the articulated boom 2, i.e. at a position that is reachable by the tool mount 3 of the articulated boom 2. The tool mount 3 may snap in the excavator bucket 21 automatically. For reaching the first changing position, the second tool carrier 50 may be pivoted from the stowed position by 90°, as derivable from a comparison of FIGS. 1 and 2.

Figure 3:
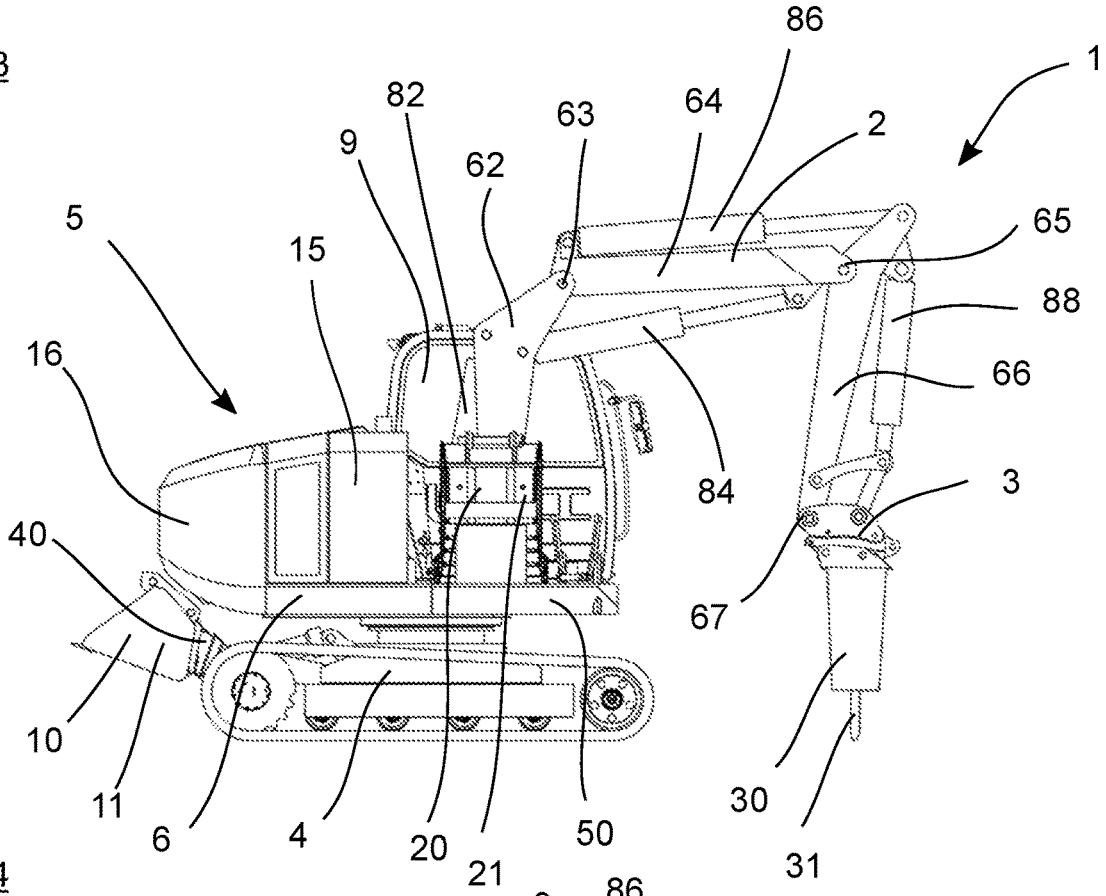
FIG. 3 generally illustrates a side view of the construction machine of FIG. 1 in a hammer mode.
Figure 4:
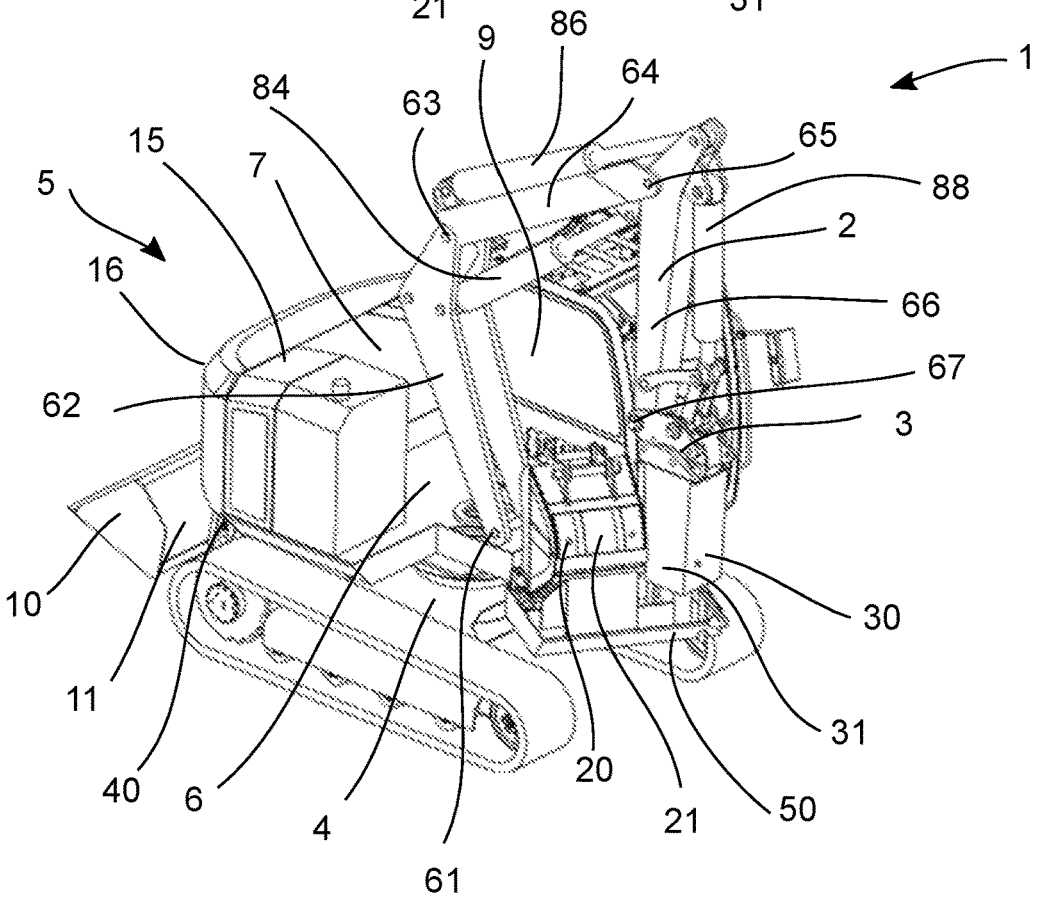
FIG. 4 generally illustrates a perspective view of the construction machine of FIG. 1 during an operational mode change to or from the hammer mode.

FIG. 3 shows the construction machine 1 in a hammer mode as a further operational mode of the construction machine 1. In this operational mode, the articulated boom 2 may be arranged in an unlocked configuration, in which all boom articulations 61, 63, 65, 67 are movable. The hammer 31 may be mounted on the tool mount 3, and the loader bucket 11 and the excavator bucket 21 may be carried by the construction machine 1.

FIG. 4 shows the construction machine 1 in a step of selecting or picking of the hammer 31 by the tool mount 3 attached to the distal arm 66 of the articulated boom 2 for operation of the construction machine 1 in the hammer mode as shown in FIG. 3. Hereto, the hammer 31 may be taken from a second tool retaining portion 154 of the second tool carrier 50 by the tool mount 3. To allow for such a pickup, the second tool carrier 50 may be pivoted from a stowed position as shown in FIG. 3 to a second changing position. In the second changing position of the tool carrier 50, the hammer 31 may picked from the tool carrier 50 by the tool mount 3. Thus, the second changing position is situated in a working space of articulated boom 2. The tool mount 3 may snap into the hammer 31 automatically. For reaching the second changing position, the second tool carrier 50 may be pivoted from the stowed position by an angle less than 90°, as derivable from a comparison of FIGS. 3 and 4.

Figure 5:
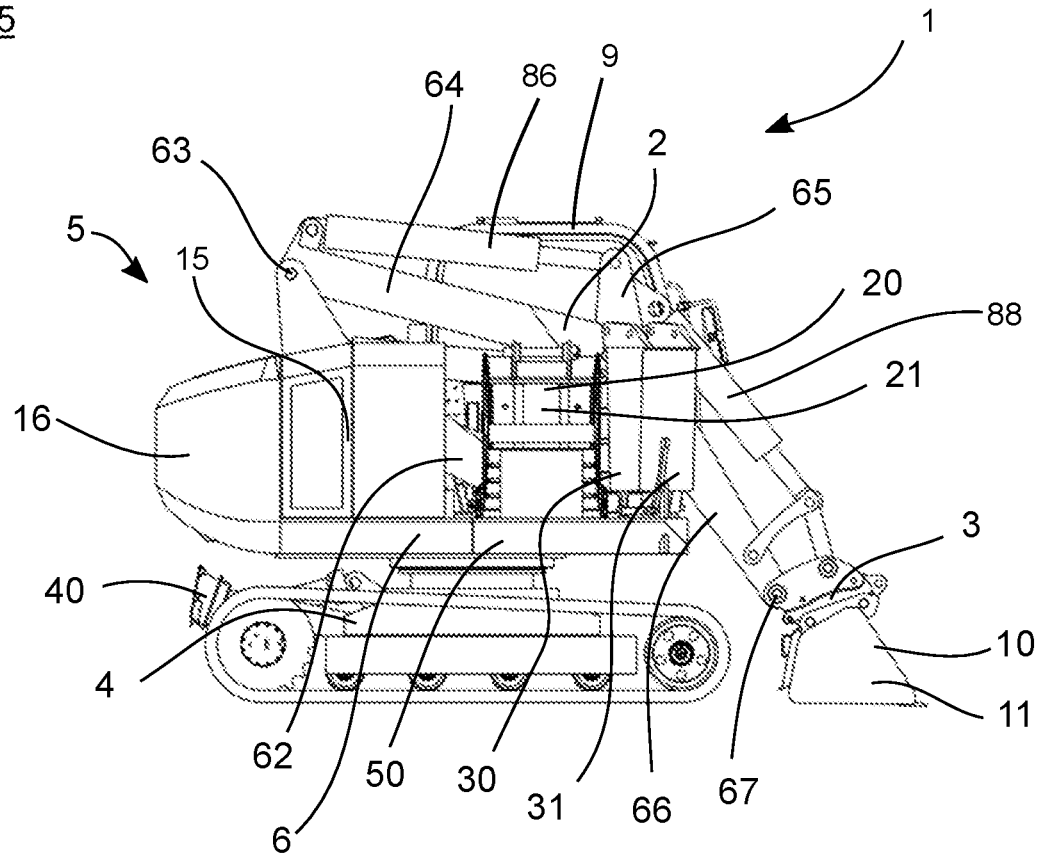
FIG. 5 generally illustrates the construction machine of FIG. 1 in a loader mode.
Figure 6:
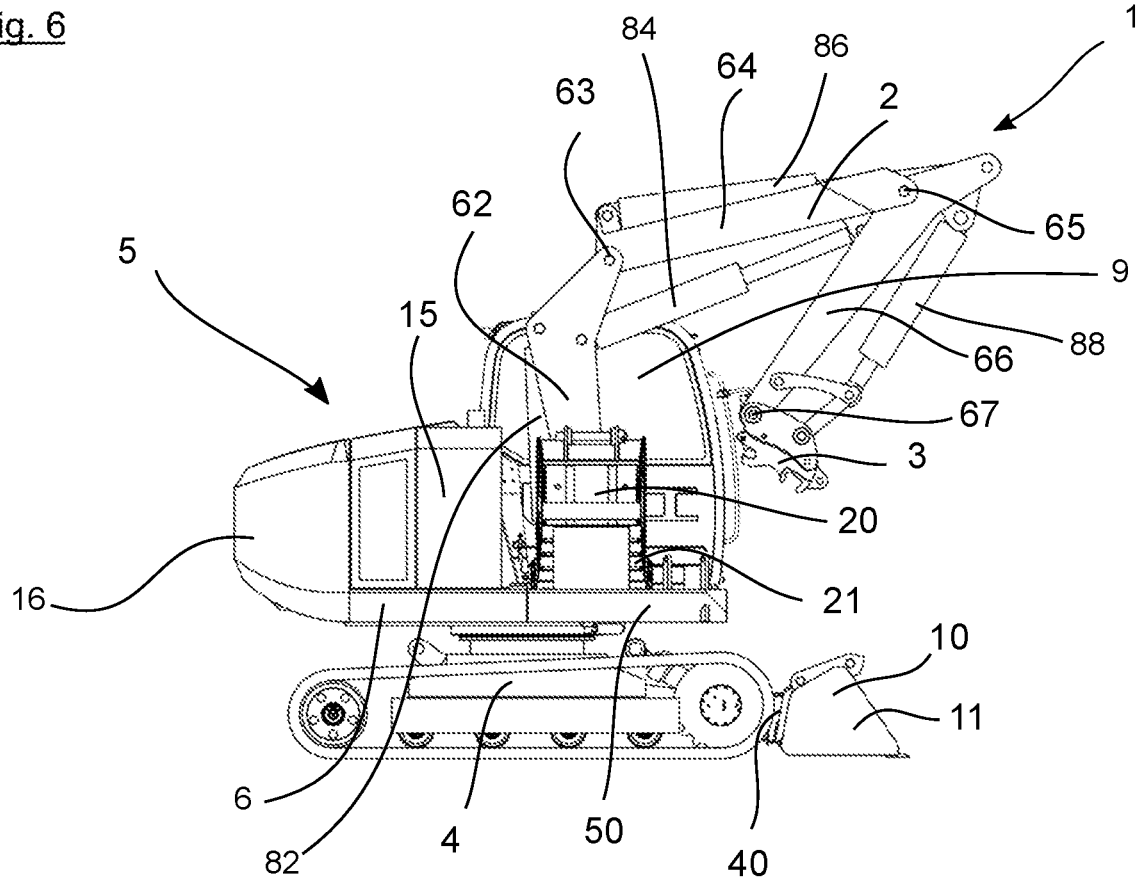
FIG. 6 generally illustrates the construction machine of FIG. 1 in a dozer mode or during an operational mode change to or from the loader mode.

FIG. 5 shows the construction machine 1 in a loader mode as a further operational mode of the construction machine 1. In this operational mode, the articulated boom 2 may be arranged in a partly locked configuration, in which the first articulation 61 may be blocked by interlocking the proximal arm 62 of the articulated boom 2 with the upper structure 5 and/or the machine frame 6 of the construction machine 1. In the loader mode, the articulated boom 2 may be de facto a two-armed boom. The loader bucket 11 may be mounted to the tool mount 3, and the excavator bucket 21 and the hammer 31 may be carried by the construction machine 1.

FIG. 6 shows the construction machine 1 in a dozer mode as a further operational mode of the construction machine 1. In this operational mode, the articulated boom 2 may be not operated. The construction machine 1 exhibits an identical configuration as that shown in FIG. 6 during a change of the operational mode to an excavator mode. For conducting such a change, the loader bucket 11 may be taken by the tool mount 3 from the first tool carrier 40 by pivoting the upper structure 5 around a vertical rotation axis to move the tool mount 3 of the articulated boom above the loader bucket 11 attached to the first tool carrier 40. The upper structure 5 may be pivoted about 180 degrees from the front of the chassis 4 to the rear of the chassis 4 for picking up the loader bucket 11. The tool mount 3 may snap in the loader bucket 11 automatically. After picking of the loader bucket 11 with the tool mount 3, the upper structure may be rotated by 180 degrees with respect to the chassis. Thereafter, the proximal arm 62 may be interlocked with the upper structure 5 and the machine frame 6, respectively, as shown in FIG. 5.

The configuration of the second tool carrier 50, i.e. the tool changer, is subsequently described with reference to FIGS. 7 to 12. In these figures, only the upper structure 5 of the construction machine 1 together with the tool changer 50 is illustrated from above and below. The tool changer 50 comprises the positioning cylinder 52 and a tool carrier articulation 54, for example a pivot joint.

The positioning cylinder 52 may be pivotably attached to the machine frame 6 adjacent to the vertical axis of rotation of the upper structure 5 and further pivotably attached to a base plate 55 of the second tool carrier 50. When extending a piston rod 53 of the positioning cylinder 52, the second tool carrier 50 may be pivoted outwardly to at least one changing position, i.e. to the first and second changing positions, and when retracting the piston rod 53, the second tool carrier 50 may be pivoted back inwardly into its stowed position.

For providing a defined pivoting movement of the second tool carrier 50 by means of the positioning cylinder 52, the tool carrier articulation 54 of the second tool carrier 50 may be arranged on the upper structure 5 and the machine frame 6, respectively. The second tool carrier 50 may be hinged to the tool carrier articulation 54 via a hinging portion 156, which may be attached to the base plate 55 and may be constructed as a pivot arm 157 for providing the pivoting movement. As described above, this may also be realized with a four-bar linkage.

Figure 7:
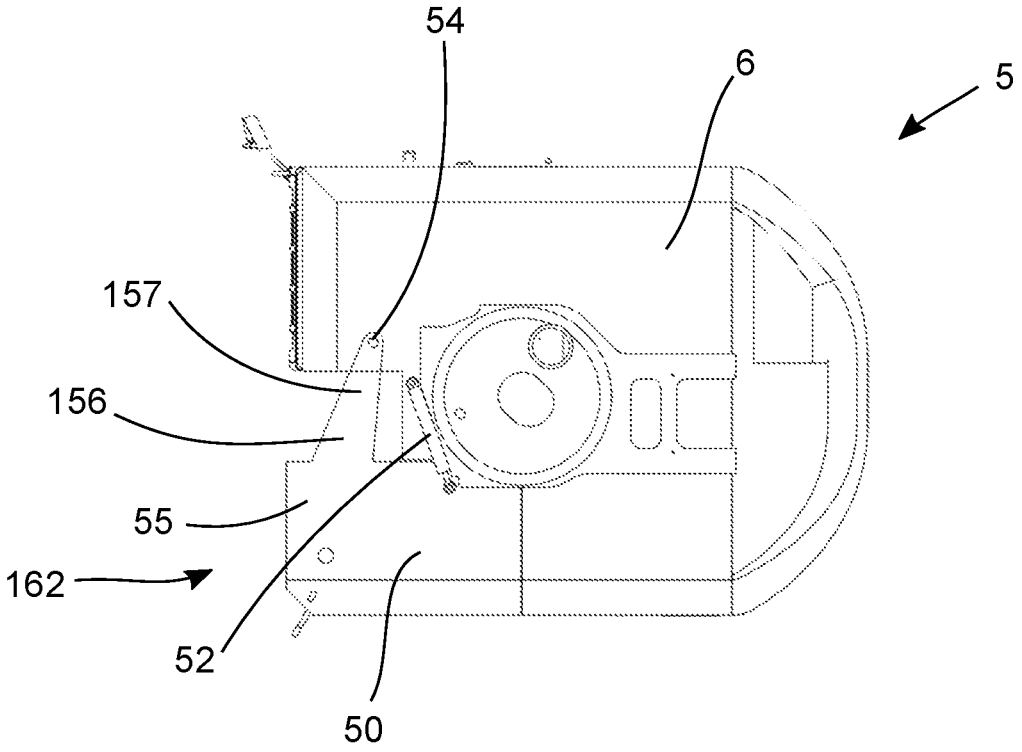
FIG. 7 generally illustrates a plan view of a bottom side of an upper structure of the construction machine of FIG. 1 with a tool changer in a stowed condition.

FIGS. 7 and 8 show the second tool carrier 50 in a stowed position, in which the second tool carrier 50 is accommodated in the upper structure 5 and the machine frame 6, respectively. Specifically, in the stowed position, the second tool carrier 50 is positioned in the frame recess 8 within the upper structure 5 and the machine frame 6, respectively. The recess 8 can be seen from above in FIGS. 10 and 12, for example. If the second tool carrier 50 is in the stowed position, the construction machine 1 may be in a loader mode, in which the excavator bucket 21 and the hammer 31 may be carried by the tool carrier 50 as shown in FIG. 8. The stowed position of the tool changer 50 may also be defined as an initial position of a tool exchange process.

Figure 9:
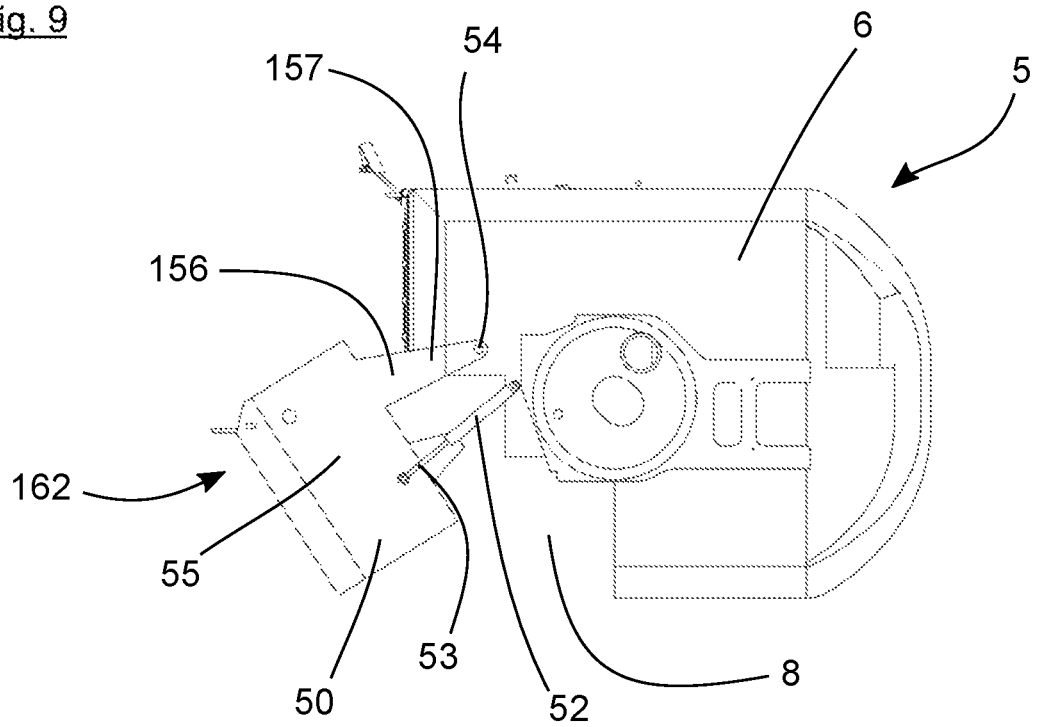
FIG. 9 generally illustrates a plan view of the bottom side of the upper structure of the construction machine of FIG. 1 with the tool changer in an alignment condition.

FIGS. 9 and 10 show the second tool changer 50 in the first changing position, in which the tool changer 50 is pivoted outwardly and away from the machine frame 6. This first changing position may be an alignment condition, in which a hammer 31 that is provided on the second tool carrier 50 may be picked up with the tool mount 3 of the articulated boom 2 (both not shown). By picking the hammer with the articulated boom 2 from the second tool carrier 50, the operational mode of the construction machine 1 may be changed to a hammer mode. In the hammer mode, the excavator bucket 21 may still be carried on the second tool carrier 50.

Figure 11:
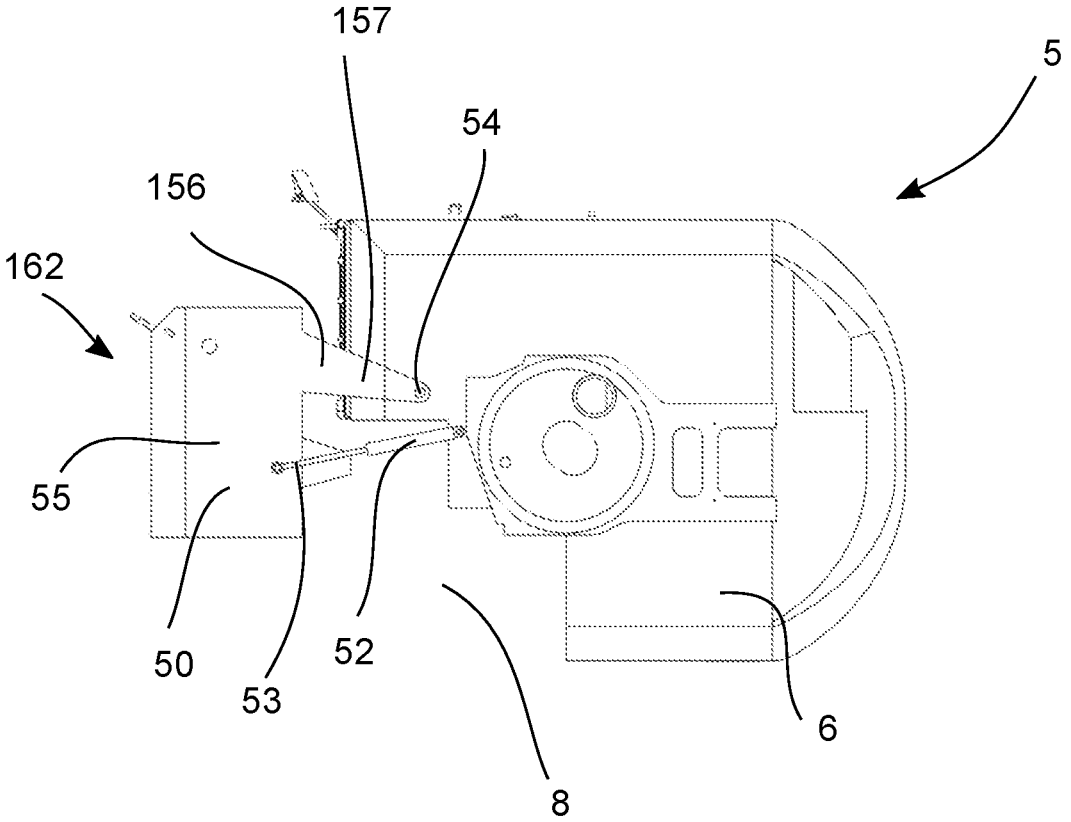
FIG. 11 generally illustrates a plan view of the bottom side of the upper structure of the construction machine of FIG. 1 with the tool changer in a further alignment condition.

FIGS. 11 and 12 show the tool changer 50 in the second changing position pivoted outwardly and away from the machine frame 6. This second changing position may be an alignment condition, in which an excavator bucket 21 that is provided on the second tool carrier 50 may be picked up with the tool mount 3 of the articulated boom 2 (both not shown). By picking the excavator bucket 21 from the second tool carrier 50, the operational mode of the construction machine 1 may be changed to an excavator mode. In the excavator mode, the hammer 31 may still be carried on the second tool carrier 50.

FIGS. 13 to 18 show the tool changer 50 with and without tools 20, 30. The excavator bucket 21 and the hammer 31 may be arranged adjacent to each other on the second tool carrier 50, wherein the excavator bucket 21 may be arranged next to the positioning cylinder 52 and the hammer 31 may be arranged next to the hinging portion 156. The excavator bucket 21 and the hammer 31 may be situated at opposite portions of the tool carrier 50. In the stowed position of the tool changer 50, the excavator bucket 21, i.e. a symmetry plane thereof, may be arranged perpendicular to a working plane of the articulated boom 2, in which the proximal arm 62, the intermediate arm 64 and the distal arm 66 of the articulated boom 2 are moved. The hammer 31 may be arranged obliquely with respect to the excavator bucket 21 in a top view from above. Furthermore, the tools 20, 30 may be arranged on the second tool changer 50 in such a way that they are aligned, i.e. such that a symmetry plane thereof is parallel, with the working plane of the articulated boom 2 in the first (excavator bucket 21) and second changing positions (hammer 31), respectively, as illustrated in FIGS. 2, 4, 10, and 12.

or additionally, with respect to the arrangement of the excavator bucket 21 and the hammer 31 on the second tool carrier 50, the excavator bucket 21 may be arranged next to the hinging portion 156 and the hammer 31 may be arranged next to the positioning cylinder 52 (this arrangement is not shown). In other words, the excavator bucket 21 and the hammer 31 may be arranged in an interchanged manner as shown and described above. Also in this alternative arrangement, in the stowed position of the tool changer 50, the excavator bucket 21, i.e. a symmetry plane thereof, may be arranged perpendicular to the working plane of the articulated boom 2. However, it is also possible that the excavator bucket 21 is arranged obliquely with respect to the working plane of the articulated boom 2 in the stowed position of the tool changer 50. The hammer 31 may be arranged obliquely with respect to the excavator bucket 21 in a top view from above. In an embodiment, a symmetry plane of the hammer 31 is arranged obliquely with respect to a symmetry plane of the excavator bucket 21 in the top view. Furthermore, also in this alternative arrangement, the tools 20, 30 may be arranged on the second tool changer 50 in such a way that they are aligned, i.e. such that a symmetry plane thereof is parallel, with the working plane of the articulated boom 2 in the first (excavator bucket 21) and second changing positions (hammer 31), respectively. In this alternative arrangement, for reaching the first changing position, the second tool carrier 50 may be pivoted from the stowed position by an angle of 90°, as described above. However, for reaching the second changing position in this alternative arrangement, the second tool carrier 50 may be pivoted from the stowed position by an angle larger than 90°. This alternative arrangement may be advantageous, as the construction machine 1 might be operated more often with the excavator bucket 21 than with the hammer 31, the arrangement of the excavator bucket 21 next to the hinging portion 156 allowing for quick installation. This alternative arrangement of the tools 20, 30 on the second tool carrier 50 may further improve visibility of a driver sitting in the driver's cabin 9.

The second tool carrier 50 may have two tool retaining portions 152, 154. The excavator bucket 21 may be carried at the first tool retaining portion 152 and the hammer 31 may be carried at the second tool retaining portion 154. The base plate 55 may be divided into the two retaining portions 152, 154. Within the first tool retaining portion 152, a seating 56 may be provided for supporting an excavator bucket 21. The seating 56 may comprise an inclined surface for accommodating the excavator bucket 21.

For securing the tools, the second tool carrier 50 may comprise clamping means 153, 155 for holding the tools. A first clamping means 153 may be provided as a clamp on the first tool retaining portion 152 for holding the excavator bucket 21 and a second clamping means 155 may be provided as a further clamp on the second tool retaining portion 154 for holding the hammer 31. Both clamping means 153, 155 may be actuated by a hydraulic cylinder 151. The first clamping means 153 may be of a pusher-type or pestle-type to exert a pressing force onto the excavator bucket 21 against the seating 56. The second clamping means 155 may be of a pliers-type to exert a holding or pressing force onto the hammer 31 from two opposite sides thereof.

For securing the loader bucket 11 to the first tool carrier 40, an interface might be provided on the machine frame 6, which may comprise at least one element for engaging with the loader bucket 11. For example, pins are driven into a wedge for realizing the engagement.

FIGS. 19 to 22 show an arrangement 100 comprising at least part of the machine frame 6, the articulated boom 2, which is pivotably attached to the machine frame 6, and a locking device 70. The articulation 61 of the proximal arm 62 of the articulated boom 2 may be arranged at the front portion of the machine frame 6 and the locking device 70 may be arranged at the rear portion of the machine frame 6. The distance lying therebetween may substantially correspond to the length of the proximal arm 62.

Furthermore, FIGS. 19 to 22 show a folded-in position of the proximal arm 62 and the intermediate arm 64 of the articulated boom 2, wherein the machine frame 6 and the proximal arm 62 as well as the proximal arm 62 and the intermediate arm 64 each form an acute angle. Folded in, the first positioning cylinder 82, the second positioning cylinder 84 and the third positioning cylinder 86 of the articulated boom 2 are substantially parallel to each other.

The locking device 70 may comprise a double hook 72 or a single hook (not shown) and an arm support 74. The arm support 74 provides a rest surface, against which the proximal arm 62 can be supported. The hook 72 may be actuated by a hydraulic cylinder 73. The hook 72 may be arranged to engageable with a pin 89 that is mounted to the proximal arm 62. Besides, the pin 89 may primarily serve for fixing a piston rod eye 90 of the first positioning cylinder 82 of the proximal arm 62.

Figure 19:
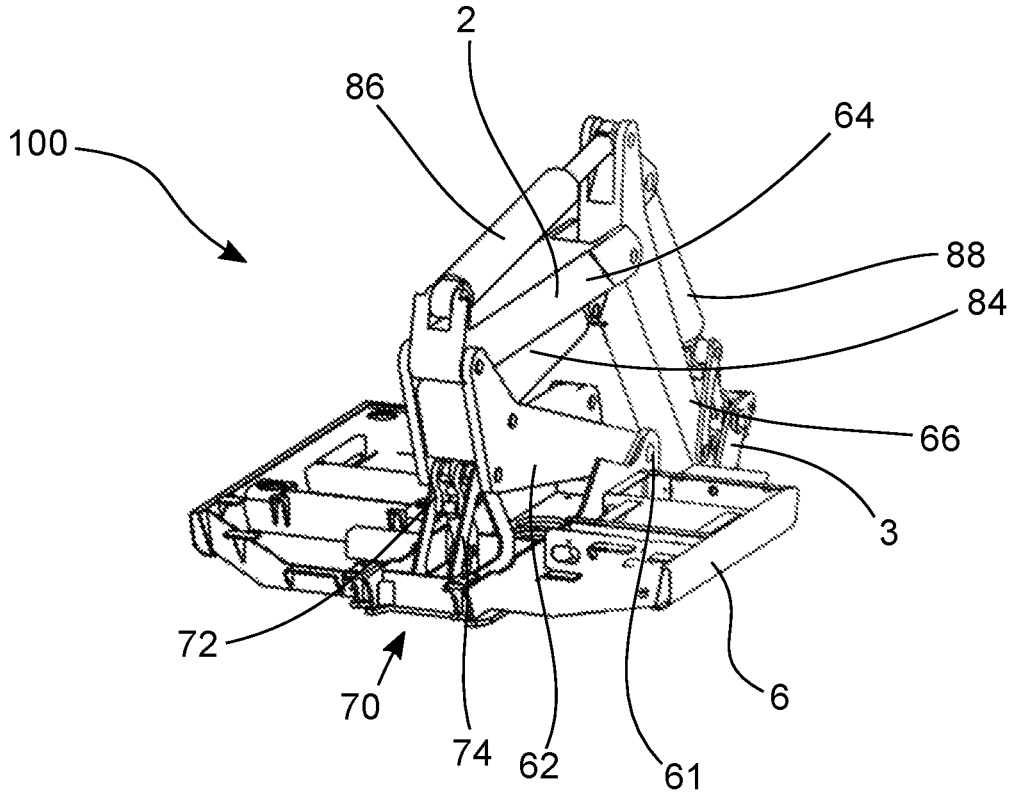
FIG. 19 generally illustrates a perspective view of an arrangement comprising a machine frame and an articulated boom of the construction machine of FIG. 1 in an unlocked configuration.
Figure 20:
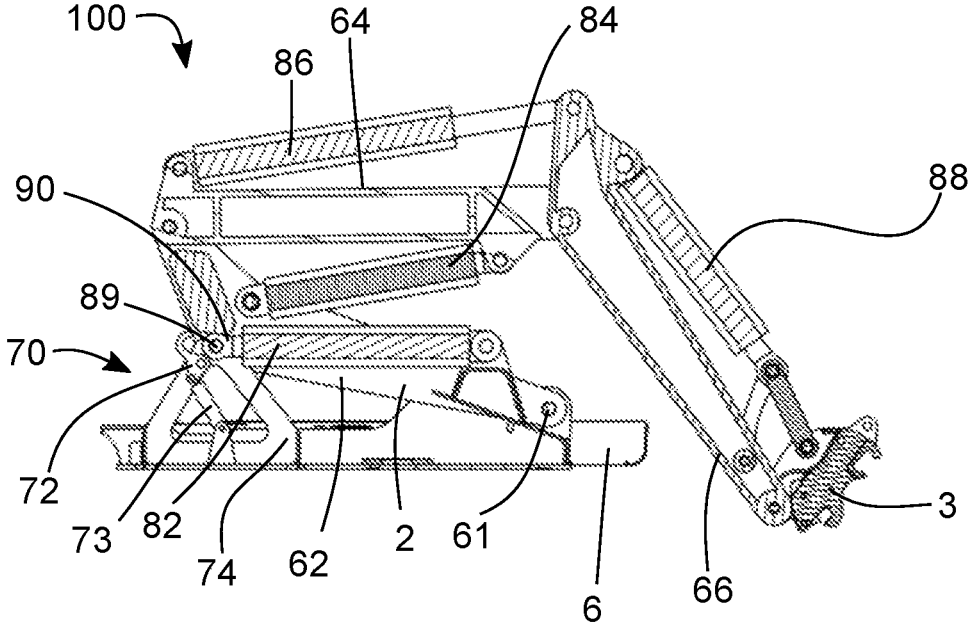
FIG. 20 generally illustrates a sectional side view of the arrangement of FIG. 19.

FIGS. 19 and 20 show an unhooked condition, in which the hook 72 does not engage with the pin 89. However, the proximal arm 62 rests on the arm support 74 allowing for hooking up of the hook 72. In this unhooked condition, the articulated boom 2 may be operated as a three-armed boom, for example in the excavator or hammer mode.

Figure 21:
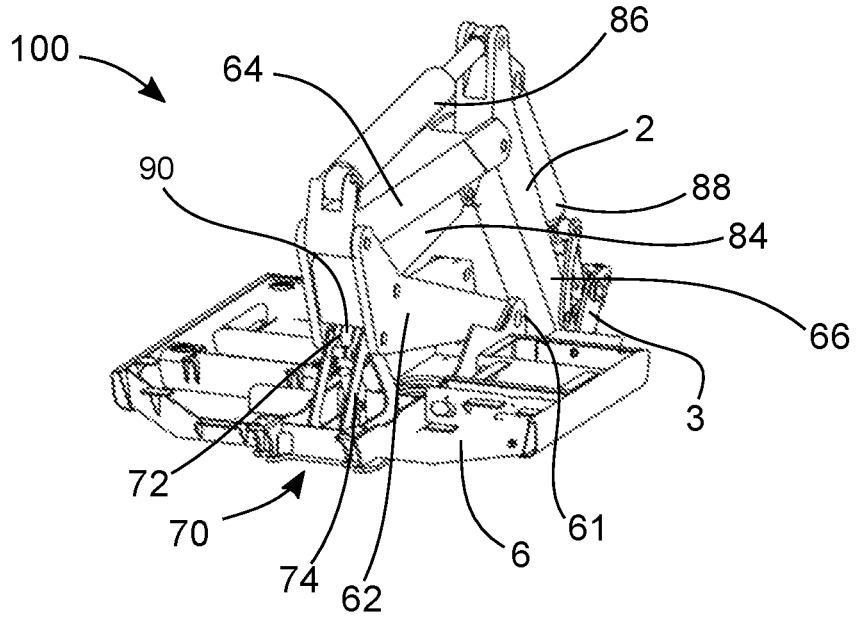
FIG. 21 generally illustrates a perspective view of the arrangement of FIG. 19 in a locked configuration.
Figure 22:
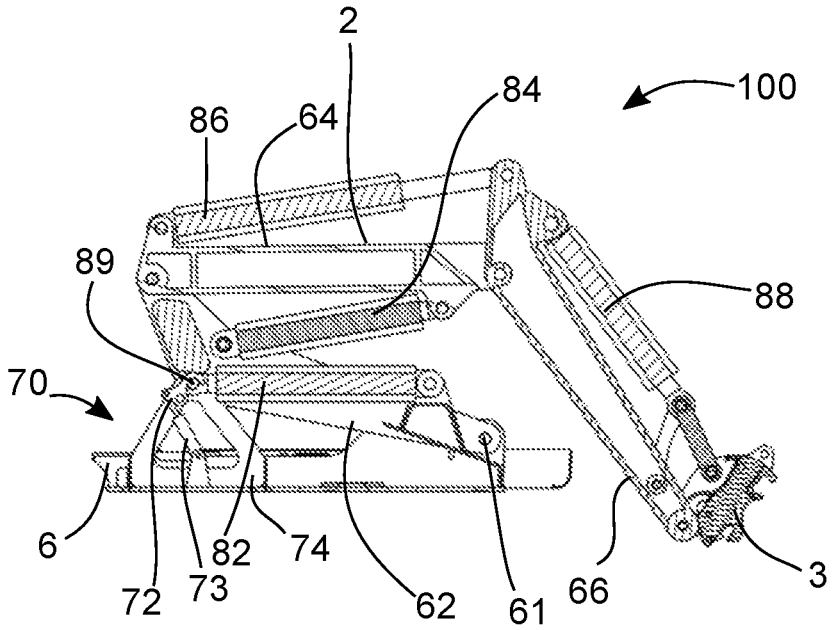
FIG. 22 generally illustrates a sectional side view of the arrangement of FIG. 21.

FIGS. 21 and 22 show a hooked-up condition, in which the hook 72 engages with the pin 89. The proximal arm 62 rests on the arm support 74 for stabilizing the arrangement 100. Based on this hooked-up condition, the articulated boom 2 may be operated as a two-armed boom, for example in the loader or dozer mode. In this hooked-up condition, the proximal arm 62 is interlocked with the machine frame 6.

According to the embodiments of the present disclosure as shown in FIGS. 1 to 22, a single construction machine 1 may be efficiently operated in several different operational modes as a plurality of tools 10, 20, 30 is directly provided on the machine body. These tools may be automatically changed by utilizing the tool changer 50, wherein a multiple-armed boom 2 may be partly blocked to allow for variable boom operations tailored to the different operational modes of the construction machine 1.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A construction machine, comprising a chassis;

a machine frame pivotably mounted to the chassis;

an articulated boom pivotably mounted to the machine frame, the construction machine configured to operate in a loader mode in which a first tool is mounted to a tool mount at a distal end of the articulated boom, and in an excavator mode in which a second tool is mounted to the tool mount at the distal end of the articulated boom; and a tool storage for storing at least one of the first tool or the second tool, comprising:

a first tool carrier being adapted to carry the first tool, wherein the first tool carrier is arranged at the chassis; and a second tool carrier being adapted to carry the second tool, wherein the second tool carrier is arranged at the machine frame, wherein the construction machine is configured to replace one of the first tool and the second tool when mounted to the articulated boom with the other one of the first tool and the second tool when stored in the tool storage.

2. The construction machine of claim 1, wherein the second tool carrier is positioned lower on the construction machine than the first tool carrier, and wherein the first tool carrier and the second tool carrier are on opposing ends of the construction machine.

3. The construction machine of claim 1, wherein the second tool carrier on the machine frame is at a lower position than the first tool carrier on the chassis, and wherein the second tool carrier is configured to minimize loading of the first tool or the second tool.

4. The construction machine of claim 1, wherein the first tool carrier or the second tool carrier comprises retaining means for holding the first tool or the second tool.

5. The construction machine of claim 1, wherein the first tool is mountable to the articulated boom in the loader mode, and wherein the second tool is mountable to the articulated boom in the excavator mode.

6. The construction machine of claim 5, wherein the first tool includes a loader bucket and the second tool includes an excavator bucket.

7. The construction machine of claim 1, wherein the tool storage is further configured to simultaneously store a third tool.

8. The construction machine of claim 1, wherein a third tool is mountable to the articulated boom in the excavator mode.

9. The construction machine of claim 8, wherein the third tool includes a hammer.

10. The construction machine of claim 1, wherein the articulated boom comprises a plurality of arms pivotably connected in series to each other, and wherein the construction machine further comprises a locking device for selectively locking at least one arm of the plurality of arms of the articulated boom, the at least one arm being directly connected to the machine frame so as to block any relative movement between the at least one arm and the machine frame in the loader mode.

11. The construction machine of claim 10, wherein the articulated boom includes three arms pivotably connected in series to each other.

12. A method for changing an operational mode of a construction machine with a chassis, a machine frame pivotably mounted to the chassis, a tool storage comprising a first tool carrier and a second tool carrier, and an articulated boom, the method comprising:

depositing, by the articulated boom, a first tool for one of a first operational mode or a second operational mode to the tool storage provided on the construction machine, the first tool being mounted to the articulated boom; and subsequently picking, by the articulated boom, a second tool for the other one of the first operational mode or the second operational mode from a tool storage provided on the construction machine, wherein the first tool carrier is adapted to carry the first tool for the one of the first operational mode or the second operational modes, wherein the first tool carrier is arranged at the chassis, and wherein the second tool carrier is adapted to carry the second tool for the other of the first operational mode or the second operational mode, wherein the second tool carrier is arranged at the machine frame.

13. The method of claim 12, wherein the construction machine includes the construction machine of claim 1.

14. The method of claim 12, wherein the first tool or the second tool is deposited in the tool storage.

15. A method for selecting an operational mode of a construction machine with a chassis, a machine frame pivotably mounted to the chassis, and an articulated boom, the construction machine being operable in a first operational mode and a second operational mode, the second operational mode different from the first operational mode, the method comprising:

simultaneously providing a first tool for the first operational mode and a second tool for the second operational mode on the construction machine; and selecting and picking one of the first tool and the second tool by the articulated boom for operation of the construction machine in the first operational mode or the second operational mode from a tool storage provided on the construction machine, the tool storage comprising:

a first tool carrier being adapted to carry the first tool, wherein the first tool carrier is arranged at the chassis; and a second tool carrier being adapted to carry the second tool, wherein the second tool carrier is arranged at the machine frame.

16. The method of claim 15, further comprising:

selecting a third tool that is configured to operate in the first operational mode or the second operational mode, wherein the third tool is configured to be stored in the first tool carrier or the second tool carrier.

17. The method of claim 15, wherein the construction machine includes the construction machine of claim 1.

18. The method of claim 15, further comprising:

locking an arm of the articulated boom that is directly connected to the machine frame of the construction machine so as to block any relative movement of the arm and the machine frame.

19. The method of claim 15, wherein the first operational mode includes a loader mode and the second operational mode includes an excavator mode.

20. A control system that is configured to execute the method according to claim 15.

* * * * *